US007287423B2

(12) United States Patent
Sabelström et al.

(10) Patent No.: US 7,287,423 B2
(45) Date of Patent: Oct. 30, 2007

(54) METHOD AND DEVICE FOR CONTROL OF THE CAPACITY OF A COMPRESSOR

(75) Inventors: Mats Sabelström, Billdal (SE); Anders Björklund, Göteborg (SE)

(73) Assignee: Volvo Lastbvagnar AB, Gothenburg (SE)

( * ) Notice: Subject to any disclaimer, the term of this patent is extended or adjusted under 35 U.S.C. 154(b) by 0 days.

(21) Appl. No.: 11/162,755

(22) Filed: Sep. 21, 2006

(65) Prior Publication Data

US 2007/0012098 A1 Jan. 18, 2007

Related U.S. Application Data

(63) Continuation of application No. PCT/SE2004/000089, filed on Jan. 22, 2004, now abandoned.

(30) Foreign Application Priority Data

Mar. 21, 2003 (SE) ..... 0300777

(51) Int. Cl.
*F04C 18/16* (2006.01)

(52) U.S. Cl. ..... 73/168; 417/298

(58) Field of Classification Search ..... 73/714, 73/168; 417/295, 298
See application file for complete search history.

(56) References Cited

U.S. PATENT DOCUMENTS

| | | | | |
|---|---|---|---|---|
| 2,782,637 | A * | 2/1957 | Scheldorf | 73/168 |
| 4,052,135 | A * | 10/1977 | Shoop et al. | 417/295 |
| 4,147,475 | A * | 4/1979 | Shoop et al. | 417/310 |
| 4,498,849 | A * | 2/1985 | Schibbye et al. | 417/299 |
| 4,676,095 | A | 6/1987 | Eberle et al. | |
| 5,811,669 | A * | 9/1998 | Polonyi | 73/116 |
| 6,227,815 | B1 * | 5/2001 | Chandra et al. | 417/298 |
| 2005/0160748 | A1 * | 7/2005 | Shaffer et al. | 62/228.1 |

* cited by examiner

*Primary Examiner*—Andre J. Allen
(74) *Attorney, Agent, or Firm*—Novak Druce & Quigg, LLP

(57) ABSTRACT

A method and device for evaluating the capacity of a compressor (1) by air being allowed to flow out from a pressure tank (3) through an opening of known geometry. Following a calculation, the quantity of evacuated air is obtained. After this, a compressor (1) pumps back up to the initial pressure in the pressure tank (3). The compressor capacity (1) is established by comparing the time it takes for the compressor (1) to pump back up to the initial pressure in the pressure tank (3) with the time it takes when an acceptable compressor (1) pumps the same quantity of air. By the compressor capacity (1) is here meant the quantity of air which the compressor (1) delivers per unit of time at a given compressor speed and counter-pressure.

17 Claims, 2 Drawing Sheets

PRIOR ART

METHOD AND DEVICE FOR CONTROL OF THE CAPACITY OF A COMPRESSOR

CROSS-REFERENCE TO RELATED APPLICATIONS

The present application is a continuation patent application of International Application No. PCT/SE2004/000089 filed 22 Jan. 2004 which was published in English pursuant to Article 21(2) of the Patent Cooperation Treaty, and which claims priority to Swedish Application No. 0300777-0 filed 21 Mar. 2003. Said applications are expressly incorporated herein by reference in their entireties.

FIELD OF THE INVENTION

The present invention relates to a method for control of the capacity of an air compressor and a device for performing the capacity test.

BACKGROUND OF THE INVENTION

In vehicle workshops, it is difficult to easily decide when a compressed air compressor incorporated in a vehicle should be exchanged and replaced by a new one. Usually, there are two criteria for exchange. The first is that the compressor shoots out oil into the compressed air. This dirties the air, but does not necessarily mean that the pump capacity is low. Since dirty air can be seen with the naked eye, it is possible to easily and immediately decide whether it is time to change the compressor.

The second criterion is that the compressor is pumping too slowly; that is to say, that the compressor produces too little compressed air per unit of time. This checking of the pump capacity is more complicated and as of yet, there has not been any simple way of gaining a reliable assessment. The checks which have been carried out in workshops have been imprecise and have not been suitable for various types of vehicle. In workshops, the test has been conducted by coupling an external manometer to the compressed air system of the vehicle and then measuring the time it takes for the compressor to raise the pressure to a certain value. This produces only an approximate time value, since it is not possible to adapt the test with regard to sources of error. For example, the test is not adaptable to the fact that different tank volumes ought to give different time values.

Other sources of error are, for example, that the air supply varies if someone climbs into and out of the car during the measurement. The air volume can also be changed by the passage of air to other reservoirs in the vehicle. Attempts have also been made to define "pump-up-time;" i.e., the time it takes when the compressor starts from a rest position until the motor has been run up to a predefined speed and the system has assumed a predefined pressure, but for practical reasons this has not proved successful in the workshops.

Owing to these difficulties in checking the compressor capacity, the compressor is in many cases changed long before its actual working life has expired. On the one hand, this is a waste of resources, and on the other hand, it is unnecessarily expensive to exchange working compressors solely because their capacity cannot be accurately assessed.

SUMMARY OF THE INVENTION

An object of the present invention is to provide a method for checking the capacity of a compressor in a simple and reliable manner. The invention also incorporates a device comprising (including, but necessarily limited to) as few constituent parts as possible for carrying out the check of the capacity of a compressor.

The term "capacity of a compressor" here denotes the quantity of air which the compressor delivers per unit of time at a given compressor speed and counter-pressure.

By virtue of the method prescribed according to the invention, the compressor capacity is able to be checked in a simple and reliable manner. The advantage with this is that it is easy to make the checks in the workshops to determine whether a change of compressor is needed.

According to the method of the present invention, the compressor capacity in the vehicle is checked by air being allowed to flow out from the pressure tank through an opening of known geometry. Following a calculation, the quantity of evacuated air is established. After this, the compressor pumps back up to the initial pressure in the pressure tank. The compressor capacity is obtained by comparing the time it takes for the compressor to pump back up to the initial pressure with the time it takes when an acceptable compressor pumps the same quantity of air.

In an advantageous refinement of the method, the air is allowed to flow out from the pressure tank for a set period. The quantity of evacuated air is calculated. After this, the compressor pumps back up to the initial pressure in the pressure tank and the time it takes to pump this known quantity of air is compared with a time value in order to evaluate the compressor capacity.

In another refinement of the method, the pressure is allowed to drop between two predefined pressures. The time which the pressure takes to drop is measured and the discharged quantity of air is subsequently calculated.

After this, the compressor pumps back up to the initial pressure in the pressure tank. The time it takes to pump this known quantity of air is compared with a reference value in order to evaluate the compressor capacity.

In another advantageous refinement of the method, prior to performance of the capacity check, a check is made that the pressure in the pressure tank lies within a predefined pressure range for a predefined time. This check enables a leakage of air from the compressed air system or to other reservoirs to be detected. Air leakage from the pressure tank renders the capacity check ineffectual.

BRIEF DESCRIPTION OF THE DRAWINGS

The invention will be described in greater detail below with reference to illustrative embodiments shown in the accompanying drawings, and in which.

DETAILED DESCRIPTION

Figure 1:
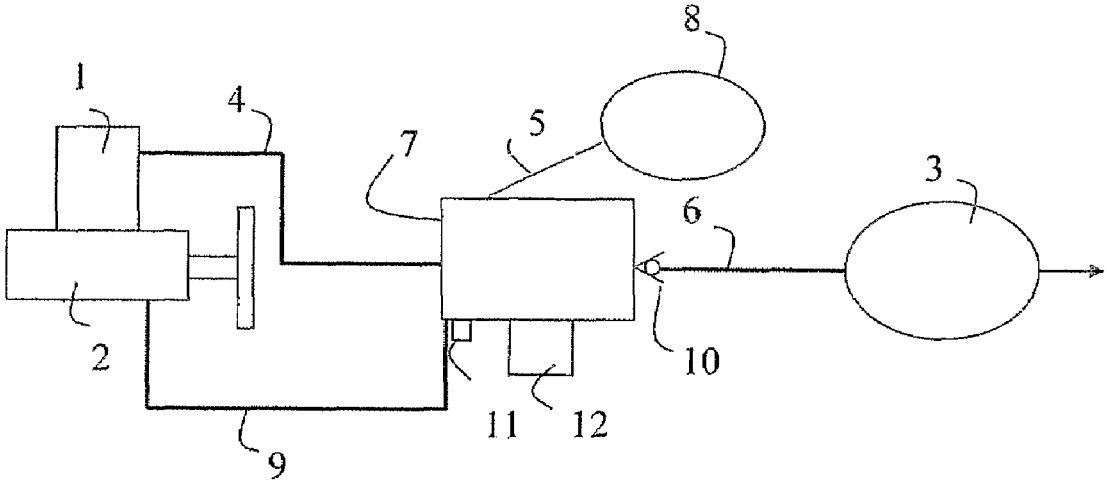
FIG. 1 is a diagram showing a traditionally controlled compressor system.

The following described illustrative embodiments of the invention, with refinements, should be regarded only as examples and should by no means serve to limit the scope of protection of the patent claims. In the illustrative embodiments described herein, the same reference numerals refer in the various figures to the same type of component.

A traditional air dryer according to FIG. 1 has a so-called off-line regeneration. The air which is pumped out from a compressor 1 deposits water droplets, which means that the air dryer 7 is exposed to moisture.

Following completion of the compression, the air dryer 7 has to be dried with dry air. The compressor 1, with incorporated motor 2, supplies compressed air to the air dryer 7 through a conduit 4. The air dryer 7 is in turn coupled, by a conduit 5, to a separate tank 8, constituting a regeneration tank containing dry air. Coupled to the air dryer 7 by a conduit 6, via a nonreturn valve 10, is a pressure tank 3. In this case, the pressure tank 3 represents the compressed-air-consuming system in the vehicle. When the pressure in the pressure tank 3 has reached a predefined maximum value, a valve 11 on the air dryer is opened in order thereby to reduce the pressure and terminate the pumping.

Should the system also contain a control conduit 9 for relieving the compressor, this conduit, too, is activated. The air in the regeneration tank 8 is thereafter fed back through the air dryer 7 for drying of the drying mass in the air dryer 7. After this, it is possible to reuse the air dryer 7. The air dryer 7 has a pneumatic control unit 12 and the air dryer also often incorporates a pneumatic control signal which runs via the control conduit 9 disposed between the air dryer 7 and the compressor 1. This pneumatic control signal enables the pumping of the compressor to be shut off, so that the pumping of air can be started and stopped in a controlled manner.

Figure 2:
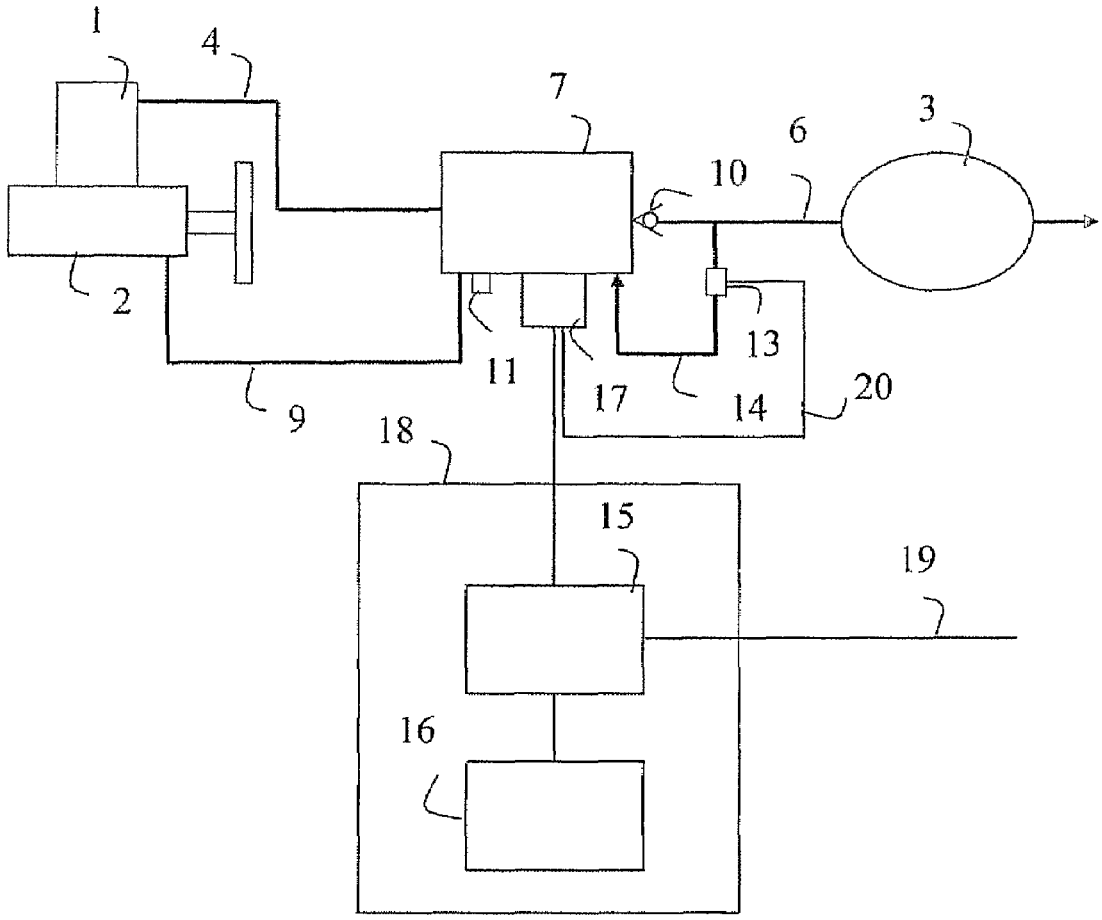
FIG. 2 is a diagram showing an electrically controlled compressor system with a test device.

An electrically controlled air dryer has a so-called in-line regeneration according to FIG. 2 for the purpose of drying the air, which means that a by-pass coupling 14 is used instead of the regeneration tank used in a traditional air dryer. The by-pass coupling 14 is disposed either in the air dryer 7 or between the pressure tank 3 and the air dryer 7. In the by-pass coupling there is a valve 13, which can be opened and can let back air from the tank to the air dryer. The valve 13 is controlled via a wire 20 from an electric control unit 17, which is either an integral part of the air dryer or a separate control unit. The air dryer 7 is dried by dry air being taken from the pressure tank 3, after which this dry air is fed back through the air dryer 7 to dry the drying mass in the air dryer 7 until the air dryer has become once again dry.

The method according to the invention can advantageously be used in an electrically controlled air dryer having a so-called in-line regeneration, since a special evacuation of air from the air tank is made on an already existing system. No extra equipment needs to be fitted on the vehicle in order to perform the capacity check on the compressor.

The test device 18 in FIG. 2 is constituted by a control unit 15 coupled to the ordinary control unit 17 of the air dryer. The control unit 15 comprises a processor, memory and suitable input and output circuits which are well known to the person skilled in the art. The control unit 15 is also connected to an instrument panel 16 for displaying generated information concerning the compressor capacity. The compressor is driven by a motor 2 and the speed of the motor is set to a predefined value prior to the start of the test. The compressor pumps air until a predefined pressure Pl is achieved in the pressure tank 3, after which the compressor is relieved of load. When this value of P1 has been found to be stable, i.e. air is not leaking out from the system, a quantity of air is evacuated from the pressure tank 3. This is affected by a valve 13 being held open for a set period, in which the air is allowed to flow out. The air flows out through an opening (not shown) of predefined size. The pressure in the pressure tank is measured as the air is evacuated and, since the diameter of the opening is known, the discharge flow, and hence the evacuated quantity of air, can be calculated. The measurement of the pressure can take place continuously; i.e., analogously throughout the measurement or at regular or irregular intervals. When the evacuation of air has been completed, an instantaneous pressure P2 is registered by the control unit 15.

The compressor then refills the pressure tank 3 until the original pressure Pl has been achieved. Once the evacuated quantity of air has been calculated, the quantity of air pumped by the compressor when the pressure in the pressure tank was increased from the pressure P2 to the pressure Pl is known. The control unit 15 measures the time tl consumed when the compressor increases the pressure from the pressure P2 in the pressure tank to the original pressure P1. The control unit then checks whether this time tl lies within a predefined time range tr. The predefined time range tr is the time consumed when a compressor with acceptable capacity pumps the corresponding quantity of air. Values of tr for different compressor speeds can be stored in a database in the control unit 15. If the time tl lies outside the predefined time range tr, the control unit 15 generates a error message indicating that the used compressor should be exchanged since its pump capacity is too low. This error message can be shown in an instrument panel 16 forming part of the test device.

In one example, a compressor is fitted on a vehicle. Since the method presupposes that no air consumption occurs during execution of the method, the method is most advantageously carried out after the vehicle has been started and the compressed air system has reached a steady state. The compressor is driven by the engine of the vehicle, which has a preset speed of 1000 rpm. The pressure P1 is set to a level below the cut-off pressure of the system, for example 11.5 bar. A valve is thereafter held open for a certain period, whereupon the air is discharged through a predefined opening of known geometry. The air flow through the opening is calculated by continuously measuring the pressure in the pressure tank and the evacuated volume is subsequently calculated. This is done by applying a generally known correlation such as Bernoulli's equation. The pressure P1 in the tank is measured prior to the start of the test. Thereafter, the pressure is measured continuously as air is evacuated for a certain period after which the evacuated quantity of air can be integrated on a forward basis. By letting the air flow out in this way, a method is obtained which is independent of the volume of the pressure tank and it is thus applicable to different types of vehicle and vehicle variants with variously large compressed air volumes. On certain vehicle variants, superstructures can be fitted which do not affect the measuring method.

The principle of measuring how great a volume is discharged from the pressure tank is that the air, for a set period, is fed out from the pressure tank through an opening of specific geometry. If Bernoulli's equation is applied, then evacuated volume is obtained according to:

$$V=f\phi dt$$

$$\phi=F(p, d)$$

in which

V=evacuated volume (liters)

$\phi$=air flow (liters/s),

P=the air pressure (Pa) and d=the diameter of the opening (dm).

The method can be initiated, for example, when the vehicle is ready for servicing in a workshop and is connected via a connection 19 to a test apparatus in the workshop (not shown). The compressor capacity is thereafter reported to a service mechanic via the test apparatus.

Another way of initiating the method is for the initiation to take place in a menu system present in the vehicle. In this case, the result is shown in the instrument panel 16.

Apart from the capacity check being simple to conduct, it is independent of the volume of the air reservoir and is therefore valid for vehicles of different types.

For a twin-cylinder compressor with 700 cc cubic capacity, a reasonable value of tl is, for example, 5 seconds, and tr can be 1.7 times t1; i.e., a deterioration in pump capacity of around 40% for an approved compressor.

In an alternative embodiment, the compressor is driven by a motor 2 and the speed of the motor is set to a predefined value. The higher the chosen speed, the quicker the test can be performed. The compressor pumps air until a predefined pressure P1 is achieved in the pressure tank. When this value of P1 has been achieved, a quantity of air is evacuated from the pressure tank 3. This is done by evacuating air through a predefined opening until a second pressure P2 in the pressure tank has been achieved and has been registered by the control unit 15. The time spent on getting the pressure to drop from the pressure P1 to the pressure P2 is used to calculate, with the aid of Bernoulli's equation, the volume of the evacuated quantity of air. The compressor pumps the pressure in the pressure tank 3 back up to the original pressure P1. The control unit 15 measures the time tl consumed when the compressor increases the pressure from the pressure P2 in the pressure tank to the original pressure P1. The control unit then checks whether this time tl lies within a predefined time range tr. If the time tl lies outside the predefined time range tr, the control unit generates a error message. This error message can be shown in an instrument panel 16 forming part of the test device.

Another refinement of the method includes a check that the first pressure (P1) in the pressure tank 3 lies within a predefined pressure range for a certain set period. A leakage of air from the compressed air system or to other reservoirs can thereby be detected. Air leakage from the pressure tank 3 renders the capacity check ineffectual.

In another advantageous illustrative embodiment, the method can be applied to a compressor forming part of a free-standing air generation unit used, for example, at building sites.

In another refinement, the monitoring can be remote-controlled via the internet or by telephone. This is particularly advantageous with respect to free-standing air generation units, which are often unmonitored. In this case, the test can be realized independently by the system. In this case, the compressor is set to conduct the test at regular intervals, for example each time it is started. The system can call a monitoring center and send error messages and/or a report of the compressor capacity.

Another advantage with the invention is that the capacity check can be realized automatically by an algorithm in the control system ensuring that the test is conducted at programmed regular intervals.

The invention should not be considered to be limited to the illustrative embodiments described above, but rather a host of further variants and modifications are conceivable and considered within the scope of the patent claims. For example, the method is not only applicable to ground vehicles, but also to, for example, airplanes, boats, and the like. As another example, a flow meter may be used at the predefined hole instead of calculating the flow from the pressure tank.

What is claimed is:

1. A method for evaluating the capacity of a compressor, said method comprising:

setting the speed of a compressor to be evaluated for capacity to a constant and predefined value;

filling a pressure tank from said compressor so that a first predefined pressure, P1, is achieved in the pressure tank and then subsequently fluidly disconnecting the compressor;

opening a valve on the pressure tank so that a quantity of air from the pressure tank is bled out through an opening of predefined size;

measuring the pressure in the pressure tank as air is bled therefrom;

shutting the valve once said quantity of air has been bled from the pressure tank;

registering instantaneous pressure, P2, in the pressure tank once the valve has been shut;

calculating the quantity of air bled from the pressure tank;

filling the pressure tank with the compressor until first pressure, Pl, is registered again in the pressure tank;

registering the time, tl, which is needed to raise the pressure in the pressure tank from the pressure P2 to the pressure P1; and generating a error message if the time, tl, lies outside a predefined time range, tr.

2. The method as recited in claim 1, wherein the step of shutting the valve occurs after a specific period of time.

3. The method as recited in claim 1, wherein the step of shutting the valve occurs once a predefined pressure P2 has been measured in the pressure tank.

4. The method as recited in claim 1, further comprising checking that the pressure, P1, lies within a predefined pressure range, Pr, for a predefined time, tf, before said quantity of air is evacuated from the pressure tank.

5. The method as recited in claim 1, wherein the steps of the method are carried out at one of (i) predefined time intervals and (ii) each time the compressor is started.

6. The method as recited in claim 1, wherein the steps of the method are initiated by a person using a menu system present in the vehicle.

7. The method as recited in claim 1, wherein the steps of the method are initiated by an outer signal.

8. The method as recited in claim 1, wherein the step of shutting the valve occurs once a predefined pressure P2 has been measured in the pressure tank.

9. A device for evaluating the capacity of an air compressor (1), said device comprising:

a pressure tank (3) having a valve (11) and an opening of known geometry, and a control unit (15), said control unit (15) being configured to set the speed of the compressor (1) to a predefined value and open and shut the valve (11) so as to evacuate a certain quantity of air from the pressure tank (3) through the opening, after which the control unit (15), via the compressor (1), fills the pressure tank (3) with said quantity of air for a certain time, tl, and compares whether the time tl lies within a predefined time range.

10. The device as recited in claim 9, wherein the device is connected to a compressor (1) forming part of a free-standing air generation unit.

11. The device as recited in claim 9, wherein the device is connected to a compressor fitted on a vehicle.

12. A method for evaluating the capacity of a compressor, comprising the following steps:

setting the speed of the compressor to a constant and predefined value;

filling a pressure tank with said compressor so that a first predefined pressure, P1, is achieved in the pressure tank and subsequently relieving the compressor;

opening a valve so that a quantity of air from the pressure tank is allowed to flow out from an opening of predefined size;

measuring the pressure in the pressure tank during the evacuation of the air;

shutting the valve once said quantity of air has been evacuated;

registering instantaneous pressure, P2, in the pressure tank once the valve has been shut;

calculating the evacuated quantity of air;

filling the pressure tank with the compressor until the first pressure, Pl, in the pressure tank is registered again;

registering the time, tl, which is needed to raise the pressure in the pressure tank from the pressure P2 to the pressure P1; and generating a error message if the time, tl, lies outside a predefined time range, tr.

13. The method as recited in claim 12, wherein the step of shutting the valve occurs after a specific period of time.

14. The method as recited in claim 12, further comprising checking that the pressure, P1, lies within a predefined pressure range, Pr, for a predefined time, tf, before said quantity of air is evacuated from the pressure tank.

15. The method as recited in claim 12, wherein the steps of the method are carried out at one of (i) predefined time intervals and (ii) each time the compressor is started.

16. The method as recited in claim 12, wherein the steps of the method are initiated by a person using a menu system present in the vehicle.

17. The method as recited in claim 12, wherein the steps of the method are initiated by an outer signal.

* * * * *